United States Patent [19]

Fogle, Jr.

[11] Patent Number: 4,975,680

[45] Date of Patent: Dec. 4, 1990

[54] LOCAL-FIELD TYPE ARTICLE REMOVAL ALARM

[75] Inventor: Homer W. Fogle, Jr., Wallingford, Pa.

[73] Assignee: ICI Americas Inc., Wilmington, Del.

[21] Appl. No.: 466,060

[22] Filed: Jan. 16, 1990

[51] Int. Cl.[5] ..... G08B 13/18

[52] U.S. Cl. ..... 340/571; 340/522; 340/527

[58] Field of Search ..... 340/571, 522, 527

[56] References Cited

U.S. PATENT DOCUMENTS

| | | | |
|---|---|---|---|
| 3,564,525 | 2/1971 | Robeson et al. | 340/571 |
| 3,750,583 | 8/1973 | White et al. | 102/70.2 |
| 3,781,860 | 12/1973 | Freyling, Jr. | 340/571 |
| 3,828,341 | 8/1974 | Carter, Jr. et al. | 340/571 |
| 3,836,901 | 9/1974 | Matto et al. | 340/571 |
| 4,511,888 | 4/1985 | Bernhardt | 340/571 |
| 4,559,529 | 12/1985 | Bernhardt | 340/571 |
| 4,573,043 | 2/1986 | Heuker et al. | 340/571 |
| 4,639,716 | 1/1987 | Payne | 340/571 |
| 4,833,456 | 5/1989 | Heller | 340/571 |

*Primary Examiner*—Glen R. Swann, III

*Attorney, Agent, or Firm*—Howson & Howson

[57] ABSTRACT

A currency alarm pack especially adapted for use in the cash supply of an automatic teller machine comprises a motion detector, an exit field detector, a smoke generating device, and electronic circuitry, responsive to the motion detector and the field detector, for triggering the smoke generator if, and only if, the field detector detects the exit field and thereafter ceases to detect the exit field, and the motion detector detects motion of the alarm pack during a predetermined delay interval following the time at which the field detector ceases to detect the exit field.

6 Claims, 3 Drawing Sheets

LOCAL-FIELD TYPE ARTICLE REMOVAL ALARM

BRIEF SUMMARY OF THE INVENTION

This invention relates to anti-theft devices and more particularly to an alarm device adapted to be concealed in or among articles likely to be stolen, for example packs of currency or cassettes containing currency such as are used in automatic teller machines.

Currency alarm packs have been developed which have the appearance of ordinary currency, but which have concealed in them alarm devices which explosively release dye or which produce other audible or visible alarms to facilitate detection of theft and apprehension of the perpetrator. In the case of a bank robbery, for example, the teller may include an alarm pack among packs of currency delivered to the robber. A timer in the alarm pack triggers an explosion at the end of a predetermined delay, causing the release of dye which makes the stolen currency identifiable, and which may also come into contact with the robber.

One form of currency alarm pack for thwarting bank robbers is described in U.S. Pat. No. 3,828,341, issued on Aug. 6, 1974 to C. H. Carter and S. M. Newfeld. The timer in the alarm pack of the Carter and Newfeld patent is activated by a localized electromagnetic field generated adjacent to the exit of the bank. For the alarm to be triggered, the alarm pack must first be taken into the field and then moved out of the field. When the alarm pack is moved out of the field, the timer is activated, and at the end of the timing interval the alarm is triggered. Provision is made in the alarm circuitry to reset the timer, and thereby prevent triggering of the alarm, if the robber returns to the field before the timer triggers the alarm.

With the proliferation of automatic teller machines (ATMs), the need has arisen for an alarm pack suitable for placement in the currency supply in such machines. The system of the Carter and Newfeld patent, while embodying a number of highly desirable features, does not adequately meet the needs of ATM protection because the ATM presents a different scenario. While it would be a simple matter to modify the Carter and Newfeld alarm pack by provision of a motion sensor, so that it can be used in an ATM, the addition of a motion sensor would not necessarily result in a satisfactory alarm pack. The motion sensor would detect any movement of the alarm pack other than its normal movement caused by the currency feeding mechanism of the ATM. Such abnormal movement would activate the alarm pack, placing it in an "awake" state for a predetermined interval of time, so that if an exit field, generated upon opening of a service access door on the ATM enclosure, is detected within a predetermined time interval following movement, and the alarm pack thereafter moves out of the exit field, a firing sequence is initiated. If the exit field is not detected within the predetermined time interval, the device reverts to its "asleep" state, in which the exit field, even if detected, has no effect.

The system of the Carter and Newfeld patent, even if modified by the incorporation of a motion detector as discussed above, is not entirely satisfactory for use in ATM money packs. In an ATM, if an electromagnetic field is provided at the location of the access door, it is difficult to prevent detection of the field by the field sensor in the alarm pack while the alarm pack is in its normal position in the currency supply of the ATM. Consequently, it is possible for unintended triggering of the alarm pack to take place.

Unintended triggering can take place under the following sequence of events. An authorized ATM service person enters the ATM through an access door to replenish the cash supply. During replenishment of the cash, the motion sensor of the alarm pack is excited because it is not possible to replenish the cash supply without moving the alarm pack. This movement causes the alarm pack to go into its "awake" state, in which it can respond to the exit field. If the service person opens the access door to depart before the alarm pack reverts to its "asleep" state, the exit field will be detected. Closing the access door quenches the field and arms the alarm pack, causing it to trigger after a predetermined time delay. The resulting dye discharge would be commercially disastrous.

The principal object of this invention is to provide an alarm pack which incorporates desirable features for theft detection, but which possesses a high degree of immunity to unintended triggering. It is also an object of the invention to provide an alarm pack which is especially suited for use in automatic teller machines. It is also an object of the invention to reduce the need for frequent service of an alarm pack by conserving battery power.

The foregoing objects are achieved in the invention by providing an alarm device adapted to be affixed to an article of property such as a simulated currency pack, where the alarm device comprises: motion detection means; field detection means; and means responsive to the motion detection means and the field detection means, for triggering the triggerable means if, and only if (a) the field detection means detects a localized field and thereafter ceases to detect the localized field, and (b) the motion detection means detects motion of the article during a predetermined delay interval following the time at which the field detection means ceases to detect the localized field.

Further objects, details and advantages of the invention will be apparent from the following detailed description, when read in conjunction with the drawings.

DETAILED DESCRIPTION

Figure 1:
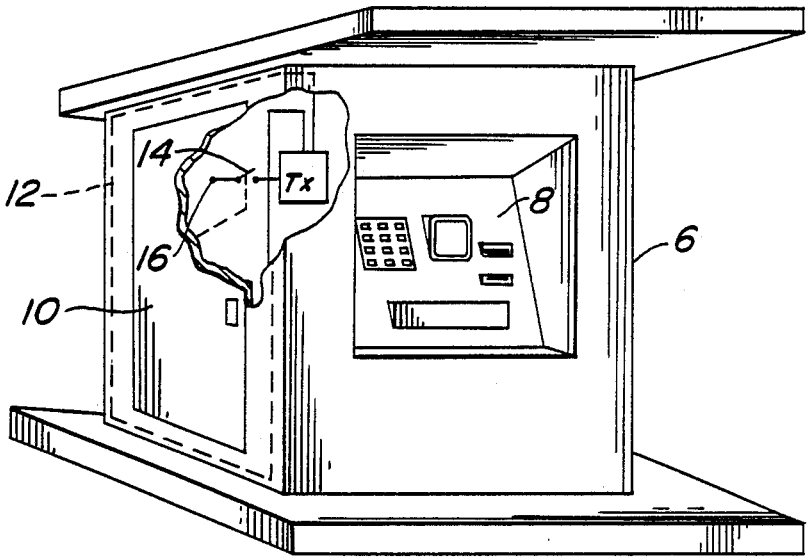
FIG. 1 is a partially broken-away perspective view of an automatic teller machine (ATM) enclosure, showing the access door and a localized field generator activated by opening of the access door.

The enclosure 6 in FIG. 1 is a typical enclosure housing an ATM 8. The enclosure has an access door 10 through which service personnel can enter and leave the interior of the enclosure for the purpose of replenishing the cash supply, repairing the machine, or performing other service functions.

The access door 10 in FIG. 1 is surrounded by an electrically conductive coil 12, which is energized by a system transmitter Tx to provide a localized induction field, preferably having a frequency, an intensity, and possibly other characteristics, such that it is not easily duplicated, either intentionally by malefactors, or inadvertently by r.f. sources such as mobile radio transmitters. The field is energized only when the access door 10 is opened, there being a door-operated switch 14 connected to deliver operating power to the transmitter from power terminal 16.

For security, currency is typically supplied to an ATM in cassettes which cannot be opened by the service personnel, or at least cannot be opened without detection. When the cash supply in the ATM runs low, the empty or nearly empty cassette or cassettes in the machine are replaced by full cassettes. Where field-responsive currency alarm packs are incorporated in the cassettes, the cassettes themselves cannot be shielded. If they were shielded, they could be stolen without activating the alarm. In an ATM enclosure, the proximity of the induction field to the ATM itself makes it impossible, or at least prohibitively expensive, to prevent the field from reaching the cassettes in their installed positions in the machine.

Currency alarm packs, having the appearance of real currency, can be included along with the currency in the ATM cassettes. The currency supply in an ATM cassette moves as banknotes are issued from the machine. Therefore, an alarm pack incorporated in the cassette also moves. The necessity for movement of the alarm pack makes it extremely difficult to disarm the alarm pack by means of a permanent magnet, such as is typically used in the cash drawer of a live teller.

Therefore, two unique conditions exist in the ATM environment. An alarm pack in the ATM cash supply cannot be easily isolated from the exit field, and because the alarm pack moves, it is virtually impossible to use magnetic means to disarm it while it is in the cassette.

Figure 2:
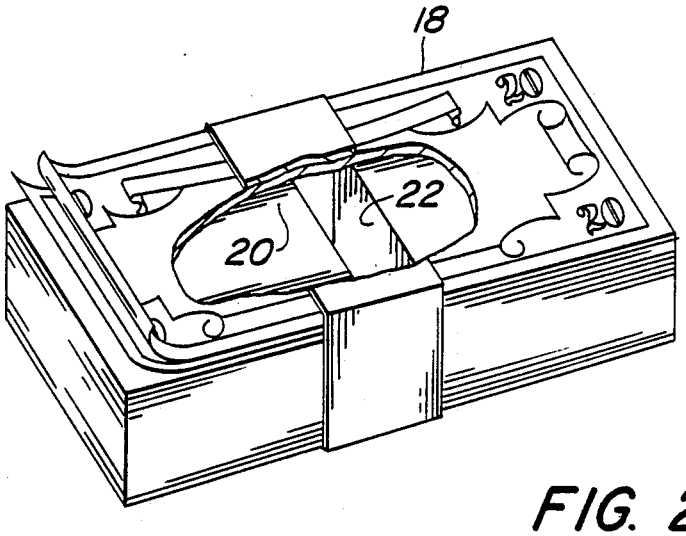
FIG. 2 is a partially broken-away perspective view of an alarm pack in accordance with the invention, showing some of the internal elements.

A currency alarm pack 18 in accordance with the invention, suitable for inclusion along with real currency in an ATM cassette is shown in FIG. 2. It includes an electronic unit 20 having a battery power supply, field and motion detectors, timers and logic circuitry, all of which will be described with reference to FIG. 3. It also includes one or more alarm devices 22, such as smoke generators, which are triggerable by the electronic unit. The smoke generators release colored smoke, which dyes the currency in a stolen cassette a distinctive color, making it essentially useless. The smoke is also released into the atmosphere making it possible to identify the person carrying the cassette easily.

Figure 3:
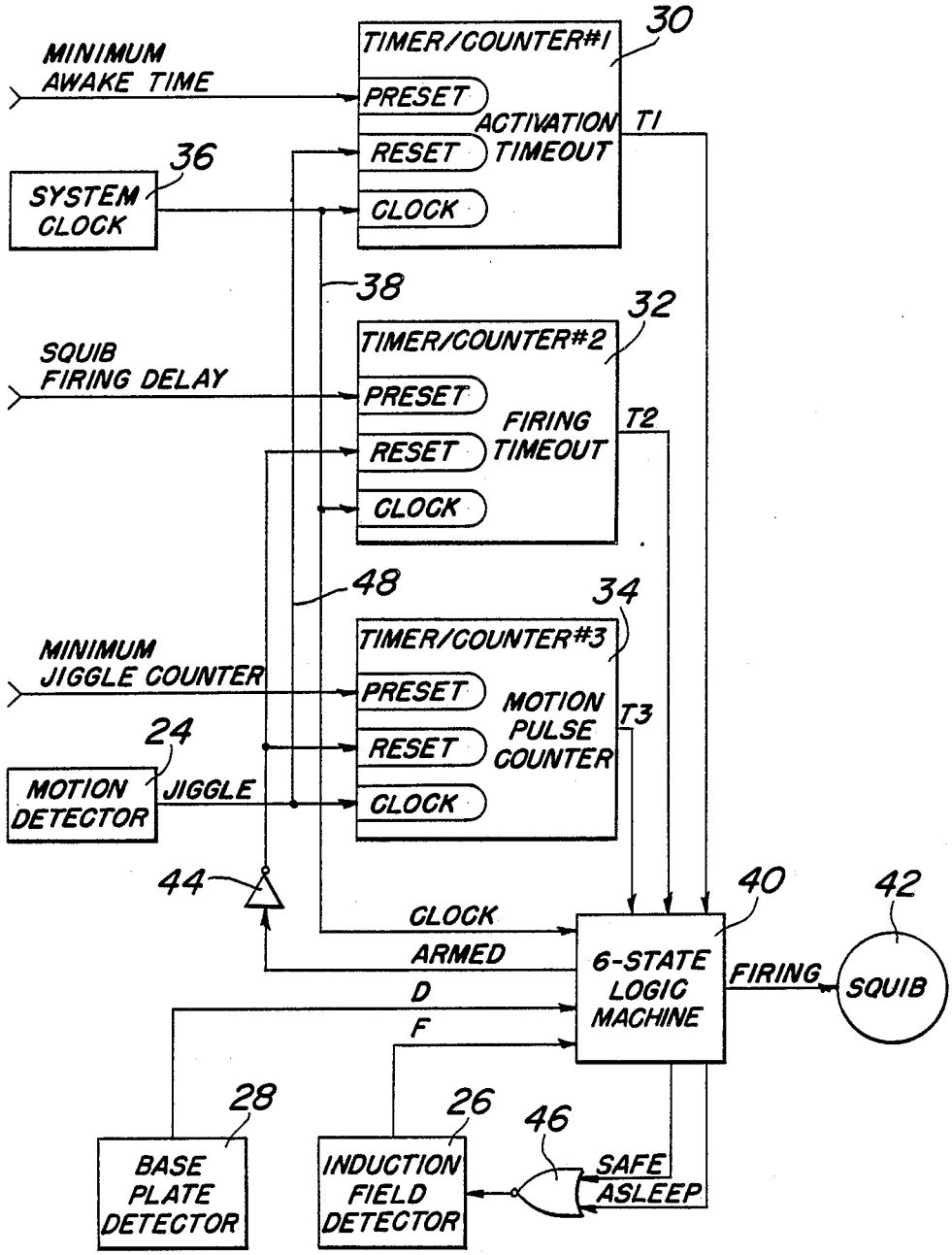
FIG. 3 is a schematic block diagram of the electrical components of a preferred form of alarm pack in accordance with the invention including a logic array.

The electronic apparatus, as shown in FIG. 3 includes a motion detector 24, which may comprise one or more mercury switches designed to close a circuit when the alarm pack is accelerated. The mercury switches are oriented so that they are not activated by the ordinary advancing movement of the alarm pack which takes place as currency is being issued by the ATM. Typically, such movement is perpendicular to the planes of the banknotes in the currency supply. Movements of the alarm pack which would necessarily take place during a theft, i.e. movements having components in the planes of the banknotes, activate the switches.

The apparatus also includes an induction field detector 26, which is a receiver tuned to the frequency of the induction field, and designed to discriminate against extraneous fields such as radio and television signals, and the field produced by 50 or 60 Hz. current in electric power lines. Although frequency-selective tuning will ordinarily suffice, sophisticated discrimination techniques, including coded pulse modulation or frequency shift keying, can be used in the system transmitter and field detector.

An optional base plate detector 28, which responds to one or more magnets in a specially designed carrier, is also included in the alarm pack of FIG. 3 to insure safety of the alarm pack when it is being shipped or carried by authorized personnel.

Three similar electronic counters are provided at 30, 32 and 34. Counters 30 and 32 count clock pulses delivered by a clock pulse generator 36 through line 38. Counter 34 is arranged to count pulses produced by motion detector 24. Each counter is presettable, through a "PRESET" input, to require a predetermined minimum count in order for its output to change from a "0" state to a "1" state. The preset count in counter 30 should always exceed the preset count in counter 32. Each counter is also resettable to a zero count, through a "RESET" input, regardless of the state of the clock input. Each of the counters is designed so that its output is a logical "0" if the count is less than the preset value or the RESET input is a logical "1", and so that its output is a logical "1" if the count is greater than or equal to the preset value and the RESET input is a logical "0". The counters do not "wrap around".

A logic machine 40, preferably a programmed logic array, receives signals from the field detector, the base plate detector, the clock pulse generator, and the three counters, and delivers a triggering signal to a pyrotechnic squib 42, which effects release of smoke from the alarm device 22 (FIG. 2). The logic machine 40 also feeds back signals to counters 32 and 34 through an inverter 44, and provides an enabling signal to the field detector 26 through a NOR gate 46. The field detector is normally disabled to conserve battery power, and motion of the alarm pack is required in order for the field detector to be enabled.

Figure 4:
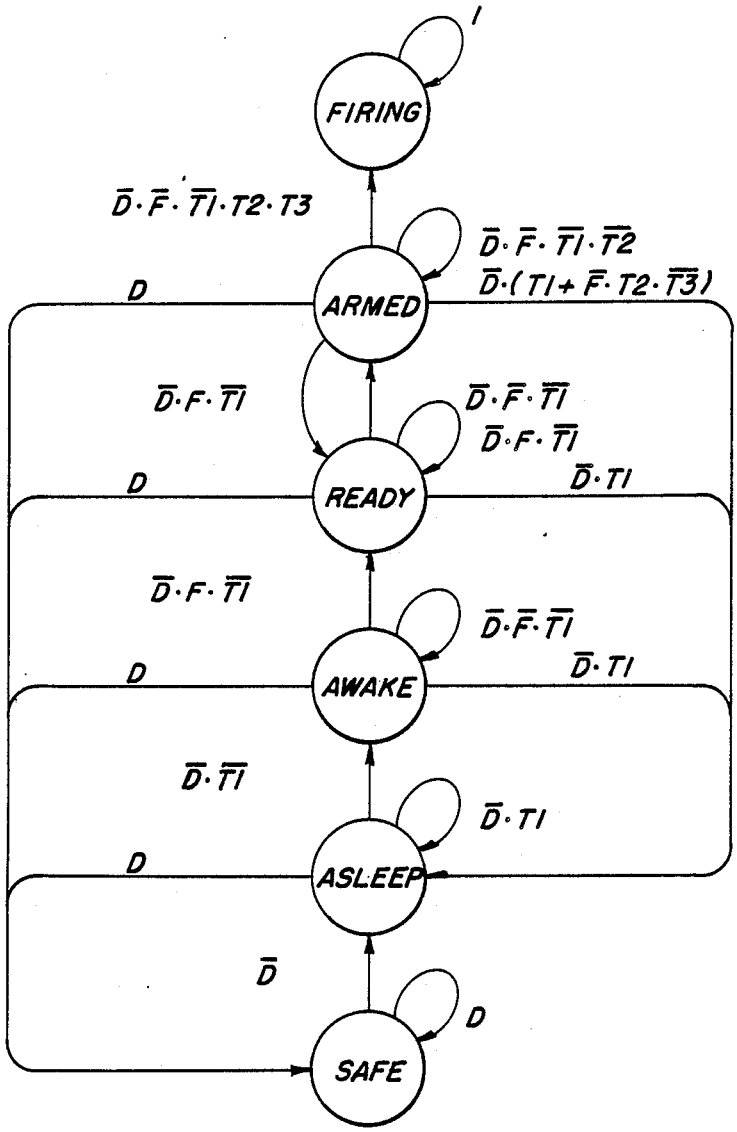
FIG. 4 is a state diagram illustrating the operation of the electrical components shown in FIG. 3.

The state diagram of FIG. 4 illustrates the operation of the electronic apparatus of FIG. 3. For the purpose of FIG. 4, "D" represents the state of the base plate detector. When the alarm pack is in a safe condition in a carrier, D is a logical "1". When the alarm pack is removed from the carrier, D is "0". T1, T2 and T3 represent the logical states of the outputs of counters 30, 32 and 34 respectively. F represents the condition of the output of field detector 26, and is a logical "1" when the detector is both enabled and detecting the induction field. D, T1, T2, T3 and F with negation symbols represent the opposite conditions. Thus, for example, "D" with a negation symbol indicates that the alarm pack is out of its carrier, and therefore not in the "safe" condition.

Assuming that the alarm pack is in place in a cassette in an ATM, it will be out of its carrier, and D will be negated. Therefore, the alarm pack will be in its "asleep" state, as depicted in FIG. 4.

Counter 30 is preset for a minimum "awake" time, for example two minutes, and will be presumed to have timed out. Therefore counter output T1 will be in the "1" state. Since the device is not yet in the "armed" state, the "armed" output of logic machine 40 will be "0" and inverter 44 will deliver a "1" to the RESET inputs of counters 32 and 34. Their counts are therefore held at zero and their outputs T2 and T3 will both be "0".

If the alarm pack is moved in the course of a theft, motion detector 24 will generate a pulse which is delivered through line 48 to the RESET input of counter 30. T1 is then negated, and the alarm pack goes into its "awake" state. Counter 30 resumes counting of clock pulses. If counter 30 reaches its preset count, its output T1 will return to "1". However, further movement will immediately cause it to be reset so that T1 returns to "0". While T1 is "0", the logic machine does not send "safe" or "asleep" signals to NOR gate 46. Consequently, field detector 26 is enabled.

If the alarm pack is already in a position to detect the induction field, or if it moves into the field, F, the output of field detector 26 will go to "1", placing the alarm pack in the "ready" state.

If the alarm pack is then moved out of the field, so that the field is no longer sensed by detector 26, F goes to "0", and the device goes into its "armed" state. At this point, the "armed" output of the logic machine goes to "1" and the output of inverter 44 goes to "0". With a "0" at their RESET inputs, counters 32 and 34 are able to count pulses. Counter 32 counts clock pulses, and counter 34 counts pulses produced by motion detector 24.

Counter 32 is preset to a count corresponding to a firing delay interval following loss of field by the field detector. Counter 34 may be preset to require any desired number of pulses from the motion detector before its T3 output goes to "1".

If T3, the output of the motion pulse counter 34, achieves the "1" state before T2 reverts to "0" state, then the logic machine 40 will send a signal causing squib 42 to fire. On the other hand, if T2 goes to "1" before T3 goes to "1", then the logic machine causes the alarm pack to revert to its "asleep" state. In other words, a predetermined motion is required during the firing delay interval as a condition for firing to take place.

The requirement for motion during the firing interval prevents unintended firing of the squib when, following movement of the alarm pack during servicing of the ATM, the alarm pack detects and then loses the exit field as a result of opening and closing of the ATM access door.

As will be apparent from the state diagram, placing the alarm pack in its protective container, causing the base plate detector output D to go to "1", causes the alarm pack to revert to its "safe" condition from any of the "armed", "ready", "awake" and "asleep" states. Similarly, if timer 30 times out, i.e. T1 goes to "0" during the "armed", "ready" or "awake" states, the alarm pack reverts to the "asleep" state unless the base plate signal D goes, or has already gone, to "1" in which case the alarm pack will go to its "safe" condition. Similarly, if the field has been detected and lost, but no motion has been detected during the firing delay interval, i.e. if F and T3 are both "0" and T2 is "1", the alarm pack will revert to its "asleep" state unless brought all the way to its "safe" state by the base plate detector signal D.

If the alarm pack is in the "armed" state, and the field is reacquired before firing takes place, the logic machine causes the alarm pack to revert to the "ready" state, resetting counters 32 and 34, and requiring another loss of field and further motion of the alarm pack for firing to take place. In this respect, the device functions in a manner similar to the device of Carter and Newfeld U.S. Pat. No. 3,828,341.

As will be apparent from the foregoing, the alarm pack of the invention is especially suited for use in the cash supply of an automatic teller machine, is highly resistant to countermeasures, and to accidental triggering. The alarm pack, of course, may also be used in cash drawers controlled by live tellers, and in other contexts in which it is desirable to associate an alarm device with property likely to be stolen.

Many modifications can be made to the apparatus described. For example, the access door of the ATM enclosure need not be surrounded by a coil, as the exit field can be provided by a smaller coil or antenna. The exit field can be in the form of a low power microwave signal, or even an ultrasonic signal. The electrical portion of the alarm pack can utilize discrete logic components instead of a programmed array. Analog timers can be used instead of digital counters, and numerous alternative circuits and alternative logic schemes can be used to perform the functions of the apparatus described. In some versions of the alarm pack, the base plate detector can be eliminated altogether. Other forms of acceleration-responsive devices, such as pendulums or balls rolling in curved channels, can be used for motion detection. Many other modifications will occur to persons skilled in the art and can be made without departing from the scope of the invention as defined in the following claims.

I claim:

1. An anti-theft device for providing an alarm in response to unauthorized movement of an article of property through a localized field comprising an alarm device adapted to be affixed to the article, the alarm device comprising: motion detection means; field detection means; and means responsive to the motion detection means and the field detection means, for triggering the alarm if, and only if (a) the field detection means detects the localized field and thereafter ceases to detect the localized field, and (b) the motion detection means detects motion of the article during a predetermined delay interval following the time at which the field detection means ceases to detect the localized field.

2. An anti-theft device according to claim 1 in which the motion detection means produces a signal in the form of a pulse when it detects motion of the article of property; in which the means for triggering the alarm comprises a clock pulse generator, first resettable counting means for counting pulses produced by the clock pulse generator and for producing a first output signal at a first predetermined count, second resettable counting means for counting pulses produced by the clock pulse generator and for producing a second output signal at a second predetermined count, third resettable counting means responsive to the motion detection means for producing a third output signal upon receipt of a predetermined number of pulses from the motion detection means, and logic means connected to receive the first, second and third output signals and also to receive signals from the field detection means and the motion detection means; the logic means producing an alarm signal, and also producing resetting signals for the second and third counting means when the first counting means reaches the first predetermined count, and requiring the coincidence of the second and third output signals in order to produce the alarm signal; and the motion detection means being connected to deliver a resetting signal to the first counting means when it detects motion of the article of property.

3. An anti-theft device according to claim 1 including a simulated pack of currency, in which the alarm device is concealed within said pack.

4. An anti-theft device for providing an alarm in response to unauthorized movement of an article of property through a localized field comprising an alarm device adapted to be affixed to the article, the alarm device comprising: motion detection means; field detection means; timing means; triggerable means for providing an alarm; and logic means, responsive to the timing means, the motion detection means and the field detection means, for triggering the triggerable means if, and only if (a) the field detection means detects the localized field and thereafter ceases to detect the localized field, and (b) the motion detection means detects motion of the article during a predetermined delay interval following the time at which the field detection means ceases to detect the localized field.

5. An anti-theft device for providing an alarm in response to unauthorized movement of an article of property through a localized field comprising an alarm device adapted to be affixed to the article, the alarm device comprising:

motion detection means providing a signal in response to the occurrence of predetermined motions of the article;

field detection means providing a signal when the detection means is in proximity to a localized field;

timing means responsive to the field detection means for establishing a delay interval following the time at which the field detection means ceases to detect the localized field;

triggerable means for providing an alarm; and logic means, responsive to the timing means and to the signals provided by the motion detection means and the field detection means, for triggering the triggerable means if, and only if: (a) the field detection means detects the localized field and thereafter ceases to detect the localized field; and (b) the motion detection means detects motion of the article during the delay interval.

6. An anti-theft system for use in conjunction with an automatic teller machine having an access door for providing an alarm in response to unauthorized movement of currency from the machine through the access door comprising: means providing a localized field; means for activating the field when the access door is opened; and an alarm device incorporated in the currency supply of the automatic teller machine, the alarm device comprising motion detection means, field detection means, and means responsive to the motion detection means and the field detection means, for triggering the alarm if, and only if (a) the field detection means detects the localized field and thereafter ceases to detect the localized field, and (b) the motion detection means detects motion of the alarm device during a predetermined delay interval following the time at which the field detection means ceases to detect the localized field.

* * * * *